US006071224A

United States Patent [19]

Lanvin et al.

[11] Patent Number: 6,071,224

[45] **Date of Patent: *Jun. 6, 2000**

[54] COPY OR WEB-GUIDING CYLINDER WITH GUIDING DEVICE FOR EXTENSIBLE OPERATING ELEMENTS

[75] Inventors: Serge Lanvin, Cires les Mello; Jean-Claude Clabrix, Cambronne, both of France

[73] Assignee: Heidelberger Druckmaschinen Aktiengesellschaft, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/907,209

[22] Filed: Aug. 6, 1997

[30] Foreign Application Priority Data

Aug. 6, 1996 [FR] France ..... 96 09901

[51] Int. Cl.[7] ..... B31F 1/00

[52] U.S. Cl. ..... 493/422; 493/425; 493/444; 493/359

[58] Field of Search ..... 493/356, 357, 493/359, 422, 424, 425, 444; 270/4, 6, 10, 19

[56] References Cited

U.S. PATENT DOCUMENTS

| | | | |
|---|---|---|---|
| 4,159,823 | 7/1979 | Bryer et al. | 493/425 |
| 4,545,782 | 10/1985 | Niemiro et al. | 493/444 |
| 5,000,729 | 3/1991 | Yamauchi . | |
| 5,417,642 | 5/1995 | Boronka et al. | 493/425 |
| 5,429,578 | 7/1995 | Calbrix et al. | 493/424 |
| 5,443,437 | 8/1995 | Mack | 493/359 |
| 5,707,330 | 1/1998 | Kiamco et al. | 493/425 |

FOREIGN PATENT DOCUMENTS

| | | |
|---|---|---|
| 413458 | 3/1910 | France . |
| 606207 | 8/1948 | United Kingdom . |

*Primary Examiner*—Eugene L. Kim

*Attorney, Agent, or Firm*—Herbert L. Lerner; Laurence A. Greenberg

[57] ABSTRACT

Provided in a copy or web guiding cylinder of a copy-processing machine is a guiding device for extensible operating elements, having at least two opposing and cooperating cylinders, wherein copies are retainable on the circumference of one of the cylinders and are transferrable by extensible operating elements into receiving elements on the circumference of the other cylinder, including coverings mounted on the one cylinder at the circumference thereof and defining an opening through which an operating element disposed in an underlying recess formed in the one cylinder is extensible.

7 Claims, 3 Drawing Sheets

COPY OR WEB-GUIDING CYLINDER WITH GUIDING DEVICE FOR EXTENSIBLE OPERATING ELEMENTS

BACKGROUND OF THE INVENTION

Field of the Invention

The invention of the instant application relates to a copy or web-guiding cylinder having a guiding device for extensible operating elements, such as folding knives or tucker blades, pins, or the like.

U.S. Pat. No. 2,991,702 discloses a folding jaw cylinder which cooperates with an opposed folding cylinder. Two folding jaws, respectively, disposed on a prestressable shaft, are provided in a recess formed on the circumference of the folding jaw cylinder, and are opened to receive a spine of a fold which is thrust by the folding knife into the free space between the folding jaws. The extent of prestressing of the torsion bars for the folding jaw may be limited by a torsion coupling. If a set or adjusted load is exceeded, an overstraining or overloading of the components is prevented by releasing the torsion coupling.

The published German Patent Document DE 42 15 911 A1 shows a folding jaw cylinder for a printing press. A folding jaw is rotatably disposed on the cylinder and includes a stop, a rotary body connectable to the cylinder and having an angular position adjustable relative to the cylinder, and a gear transmission for setting an operating space between the folding jaw and the stop by adjusting the angular position between the cylinder and the rotary body. The stop is movably disposed on the cylinder and, when the angular position between the cylinder and the rotary body is adjusted, the stop is adjusted relative to the cylinder by adjusting means applied to the rotary body and secured to the stop. The folding knife cooperating with the corresponding folding jaws is accommodated in quite a large recess, as viewed in the circumferential direction.

The published German Patent Document DE 29 36 768 C2 discloses an adjustable folding device or folder for rotary printing presses. On a collecting or gathering cylinder shown in this reference, the folding knives are received in folding knife cassettes on the circumference of the cylinder.

The published German Patent Document DE 690 08 007 T2 shows a folding and cutting apparatus for a web of printing paper. In this configuration, mutually opposing folding knives are mounted on a folding knife cylinder and are secured in recesses. A recess formed on the circumference of the folding knife cylinder and extending circumferentially on both sides of the edge of the folding knife impairs the accuracy or precision of the copy transfer from the folding knife cylinder to the folding jaw cylinder in the folding apparatus.

It has been found that the recess extending in the circumferential direction on either side of the folding knives on the folding knife cylinder has the effect, at relatively high production speeds, of causing the copy to be thrust by the folding knife into an opposing just-opened folding jaw to enter the recess surrounding the folding knife and become creased. The impact of the folding knife as it moves outwardly on the copy creates a pulse which is propagated over the copy in the form of an undulating or wavelike discontinuity or disruption on both sides of the impact location of the outwardly moving folding knife, causing temporary deformation of the copy to be transferred.

SUMMARY OF THE INVENTION

In view of the foregoing proposals presented in the prior state of the art and the technical subject matter discussed in the aforedescribed prior art publications, it is an object of the invention to provide a copy-guiding cylinder with a guiding device for extensible operating elements whereby the accuracy or precision of copy transfer between two copy-guiding cylinders is improved, and consequences of the so-called "whipping effect" is reduced.

With the foregoing and other objects in view, there is provided, in accordance with the invention, in a copy or web guiding cylinder of a copy-processing machine, a guiding device for extensible operating elements, including at least two opposing and cooperating cylinders, wherein copies are retainable on the circumference of one of the cylinders and are transferrable by extensible operating elements into receiving elements on the circumference of the other cylinder, comprising coverings mounted on the one cylinder at the circumference thereof and defining an opening through which an operating element disposed in an underlying recess formed in the one cylinder is extensible.

In accordance with another feature of the invention, the coverings are formed with rounded features on a side thereof facing towards the opening through which the operating element is extensible.

In accordance with a further feature of the invention, the opening through which the operating element is extensible is adaptable to different thicknesses of the operating element.

In accordance with an added of the invention, the coverings are displaceably received on the cylinder surface.

In accordance with an additional feature of the invention, the coverings are formed of abrasion-resistant plastic material.

In accordance with yet another feature of the invention, the coverings are formed of metal.

In accordance with yet a further feature of the invention, the coverings have an opening formed therein.

In accordance with a concomitant feature of the invention, the opening is formed as a slot.

The coverings mounted adjacent to the opening through which the operating element, such as a folding knife, is extensible support the copy from below in the region of the impact location of the operating element. The regions of the copy adjacent to the impact location of the folding knife, for example, are then prevented from swinging back into the recess wherein the folding knife is received, so that an undulating or wavelike discontinuity, which finally engages the entire product, cannot develop.

In a further feature of the concept upon which the invention is based, the coverings are rounded on sides thereof facing towards the outlet opening and consequently afford a low-wear and gentle retraction and extension, for example, of folding knives. With the aid of the coverings, the outlet opening through which the operating element is extensible and retractable can be adapted to various different thicknesses of the operating element. To that end, the coverings which define or border on the outlet opening for the operating element at the circumference of the respective cylinder are displaceably mounted on the circumferential surface of the cylinder.

Other features which are considered as characteristic for the invention are set forth in the appended claims.

Although the invention is illustrated and described herein as embodied in a copy-guiding cylinder with a guiding device for extensible operating elements, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
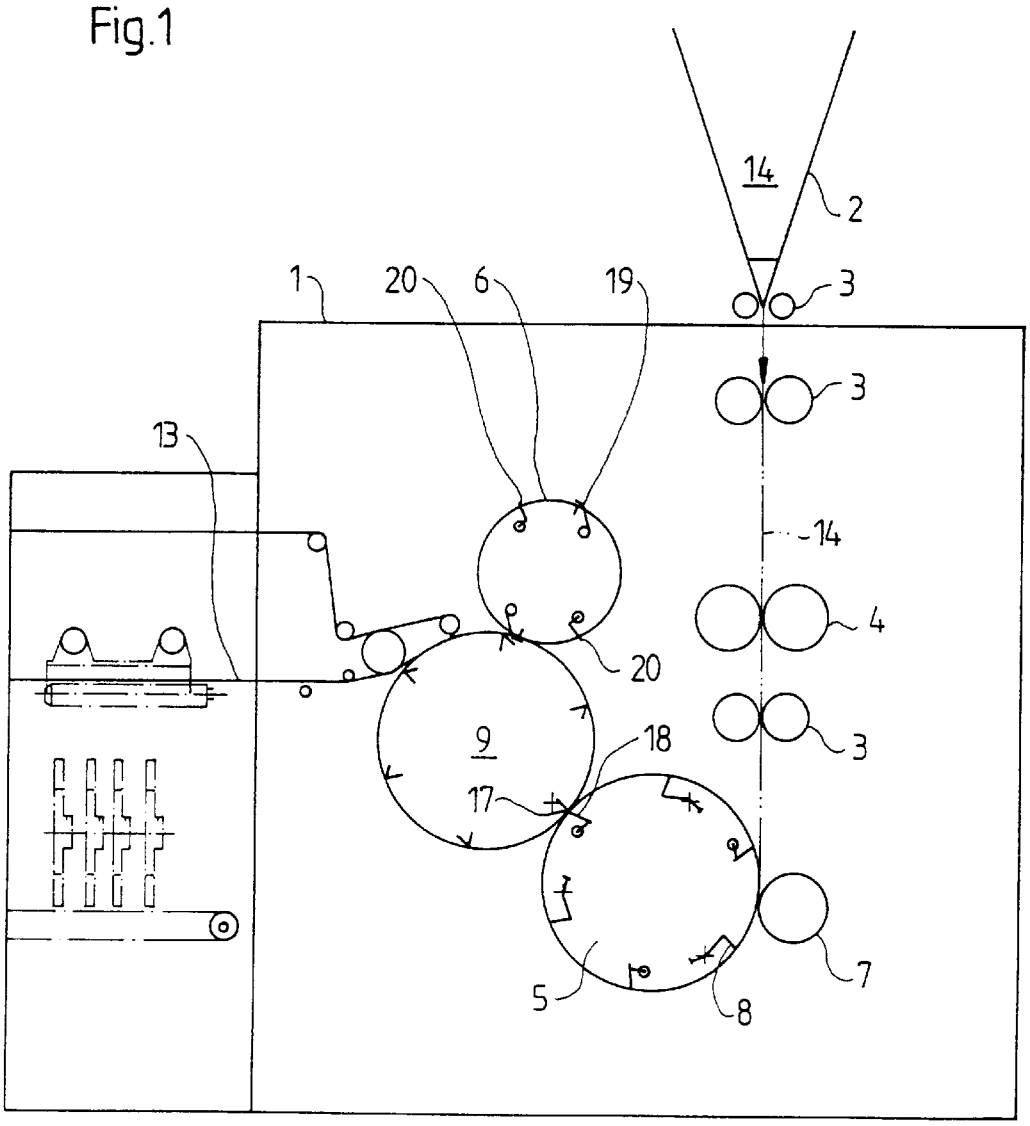
FIG. 1 is a diagrammatic side elevational view of a folder or folding apparatus.

Referring now to the drawings and, first, particularly to FIG. 1 thereof, a folder or folding apparatus is shown therein diagrammatically. A funnel-shaped folder former 2 is disposed at the top of the folding apparatus. The folder former 2 longitudinally folds at least one web 14 which enters a cylinder part 1 of the folding apparatus, which includes folding cylinders and folding drums. The longitudinally folded paper web 14 is then cut crosswise with respect to the web travel direction represented by the arrow associated therewith. A cutting cylinder 7, which is associated with a lower folding knife cylinder 5, severs copies from an end of the web 14 located upstream therefrom. The copies are then punctured and held by pins 8 of the folding knife cylinder 5. The folding knife cylinder 5 cooperates with a folding jaw cylinder 9 in a manner that a respective folding knife 18 on the folding knife cylinder 5 thrusts the spine of the fold of a respective copy into respective folding jaws 17 provided on the circumference of the cylinder 9. The folding jaws 17 hold the copy and then place it on a delivery 13. The copy can, on the other hand, also be provided with a further, additional fold, by an additionally provided upper folding cylinder 6, as viewed in FIG. 1. In such a case, grippers 19 of the upper folding knife cylinder 6 grip the copy which is also held by the folding jaws 17. Finally, the copy is thrust by a respective folding knife 20 of the upper folding knife cylinder 6 into the respective folding jaws 17 of the cylinder 9, which then carries the copies to the delivery 13.

Figure 2:
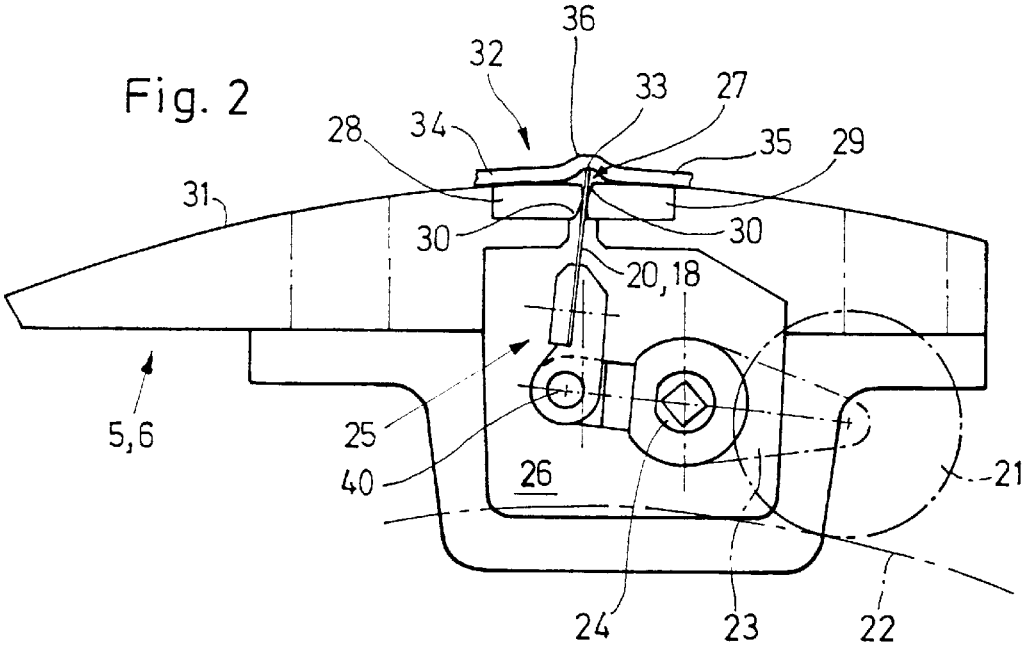
FIG. 2 is an enlarged fragmentary view of FIG. 1 showing a folding knife extending from the circumferential surface of a cylinder for forming a fold.
Figure 3:
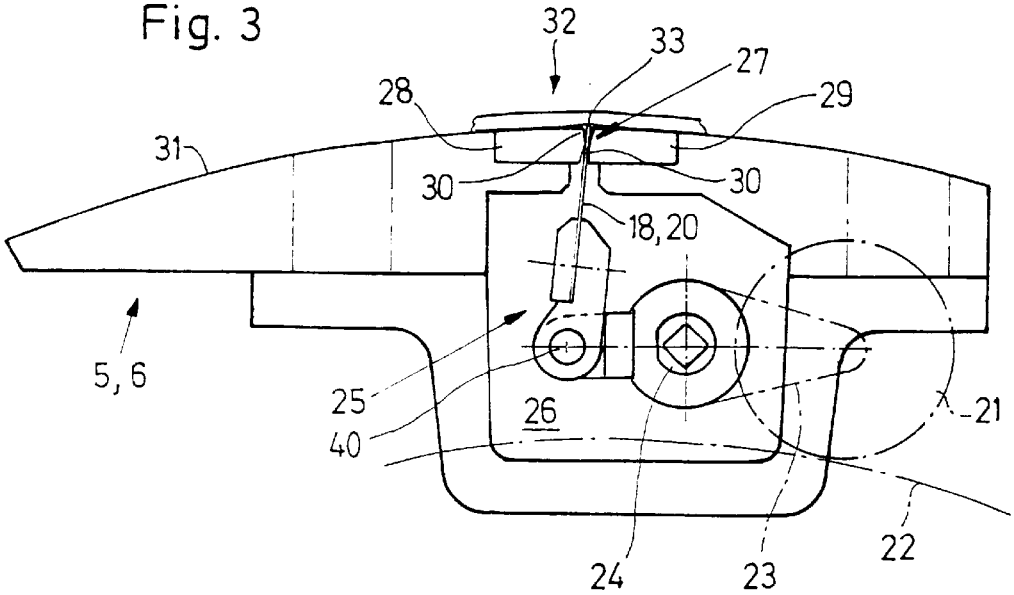
FIG. 3 is another view like that of FIG. 2 wherein the folding knife remains lying in the circumferential surface of the cylinder.

In FIGS. 2 and 3, a folding knife bearing support and a cam control therefor are shown on a larger scale.

In FIG. 2, a cam control for actuating operating elements, such as folding knives 18, 20, is suggested diagrammatically at an end of a fragmentarily illustrated folding knife cylinder 5 or 6. A shaft 24 is received in a recess 26 formed in the folding knife cylinder 5 or 6, and has a folding knife bearing 25 secured to one end thereof and a lever 23 to the other end thereof, the lever being provided with a control roller 21. The shaft 24 includes a control piece 40, which supports or assists in a retraction and extension of the folding knife 20. The control roller 21, rolling on a diagrammatically represented control cam 22, produces an oscillating motion of the shaft 24 and effects a retraction or extension of the folding knives 18 and 20, so that they are capable of forming crosswise folds in the respective copy 32 resting on the cylinder surface 31.

Figure 4:
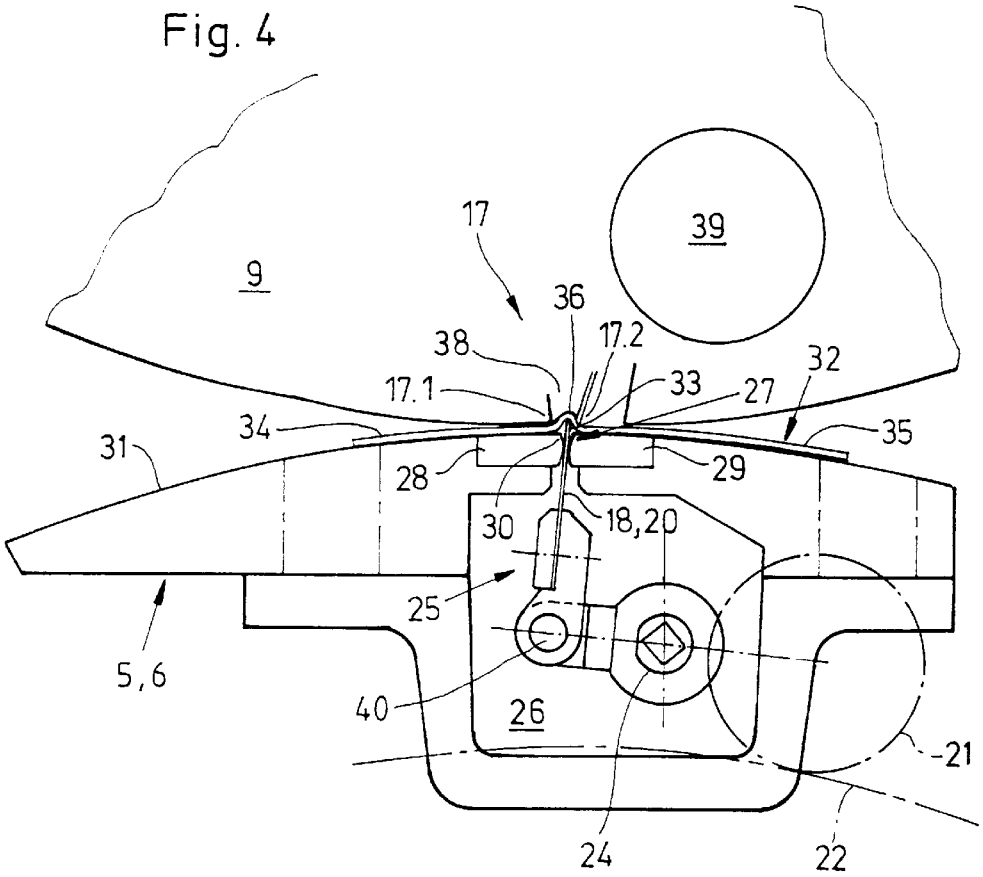
FIG. 4 is yet another view like those of FIGS. 2 and 3 wherein the folding knife cylinder thereof is shown in substantially tangential engagement with a folding jaw cylinder, and wherein a folding spine of a copy is shown thrust into an opposed folding jaw of the folding jaw cylinder.

To form the crosswise fold in the copy 32, the operating element 18, 20, which is embodied as a folding knife in FIGS. 2 and 3, strikes the copy 32 at an impact line 33 and thrusts the developing spine of the respective fold 36 of the copy 32 into an opposed folding jaw 17 (also note FIG. 4). The operating element 18, 20 formed as a folding knife in this embodiment pushes through and past the cylinder surface 31 through an extension opening 27 which is bounded laterally by respective coverings or lids 28 and 29. The coverings 28 and 29 may be embodied as lateral guides of the folding knife. The coverings 28 and 29 are formed with rounded edges 30 at respective sides thereof facing towards the operating element 18 or 20, thereby enabling the material of the operating elements 18 and 20 to be treated gently relative to the coverings 28 and 29 and thus preventing any deformation of the coverings 28 and 29 and the folding knives 18 and 20. The coverings 28 and 29, which are of such dimensions that the extension opening 27 is of a size adequate for accommodating the operating element 18, 20, support the copy 32 on both sides of the impact line 33 and prevent it from swinging into the recess and, accordingly, becoming creased and/or dog-eared when the folding knife 18, 20 is extended. The coverings 28 and 29 also prevent the consequences of the so-called "whipping effect" upon the transfer of a copy from one cylinder to the other, and thus prevent undesired creasing of the copies.

The rippling or wavelike motion of the lefthand and righthand sides 34 and 35 of the copy, as viewed in the figures, a motion which arises upon the impact of the folding knife 18, 20 with the copy 32, is effectively damped, so that the copy 32 to be transferred to the folding jaw cylinder 9 moves in an overall controlled manner into the respective opposing folding jaw 17, as is apparent from FIG. 4.

FIG. 3 shows a folding knife 18, 20 which remains retracted into the circumferential surface of the cylinder. In the condition or phase shown in FIG. 3, the folding knife 18, 20 forms a spine of the fold 36 along an impact line 33 which extends perpendicularly to the plane of the drawing. In the phase shown in FIG. 3, however, the copy 32 remains at rest on the circumferential surface 31 of the folding knife cylinder 5, 6, supported by the coverings 28 and 29 adjacent to the extension opening 27. An arch or curvature on the underside of the copy 32 indicates the location of the impact line 33, at which the spine of the fold 36 will be formed. In the operating phase shown in FIG. 3, the shaft 24 has just rotated counterclockwise to an extent that the folding knife 18, 20 is just emerging from the circumferential surface 31 of the folding knife cylinder 5 or 6. An oscillating motion is imposed upon the shaft 24 by the roller/cam control 21, 22, which is represented diagrammatically in FIG. 3.

The coverings 28 and 29 which border on the extension opening 27 can be adapted to the thickness of the operating element 18, 20 in a relatively simple manner by lateral displacement, if a thicker folding knife 18, 20, for example, should come to be used. In this regard, it is necessary only to mount narrower coverings 28, 29 at the surface of the respective folding knife cylinder 5, 6. The rounded features 30 at the edges of the coverings 28, 29 enable relative movement between the folding knife 18, 20 and the coverings 28 and 29 which is gentle to the materials thereof, because the folding knife 18, 20 is not retracted and extended strictly vertically, but rather at a slight inclination to the normal. The coverings 28 and 29 may also be used in copy-guiding cylinders having retractable and extensible pins for puncturing the copies.

FIG. 4 shows a folding knife cylinder 5 or 6 which cooperates with a folding jaw cylinder 9. The folding jaw 17 provided on the folding jaw cylinder 9 receives in an opening 38 thereof the spine of the fold 36 of the copy 32 to be transferred. The spine of the fold 36 is formed by the impact line 33 which is produced on the inner side of the copy 32 due to the extension of the folding knife 18, 20, and is retained between respective fixed and movable folding jaw parts 17.1 and 17.2 of the folding jaw 17. Because the copy 32 is supported from below by the coverings 28 and 29 adjacent to the extension opening 27 at the instant of time that the spine of the fold 36 is thrust into the flap 38, no wavelike discontinuity or disruption can propagate in the lefthand or righthand side 34, 35 of the copy after the impingement of the folding knife 28 with the underside of the copy 32; i.e., the transfer of the copy 32 is effected more precisely, when a crosswise or transverse folding operation as described hereinabove is performed, because fewer interfering factors are present.

Disposed in the folding jaw cylinder 9 is a control roller 39, which is connected to the movable part 17.2 of the folding jaw 17, which has been opened before entry of the spine of the fold 36, or closed after entry of the spine of the fold 36 into the folding jaw 17.

The coverings 28 and 29 can advantageously be formed of tough plastic material, which simultaneously has good sliding properties in the region of the rounded features 30, so as to maintain low wear and minimize stresses and strains on the material. It would also be conceivable for the coverings 28 and 29 to be formed as metal components, such as rails which are embedded in the circumferential surface 31 of the cylinders 5 and 6. By being screwed down in the region of the ends of the cylinders 5 and 6, the coverings 28 and 29 can be adapted readily to the thickness of different folding knives 18 and 20 or of other operating elements 18 and 20. In this regard, the coverings 28 and 29 have oblong holes or slots formed therein, which permit easy displacement of the coverings 28 and 29 towards or away from the extension opening 27.

We claim:

1. In a copy or web guiding cylinder of a copy-processing machine, a guiding device for extensible operating elements, including at least two opposing and cooperating cylinders, wherein copies are retainable on the circumference of one of the cylinders and are transferable by extensible operating elements into receiving elements on the circumference of the other cylinder, comprising coverings mounted on the one cylinder at the circumference thereof, each of said coverings having an edge portion, said edge portions defining an opening through which an operating element disposed in an underlying recess formed in the one cylinder is extensible for forming an impact line on a copy, said opening having a width substantially corresponding to a thickness of the operating element and being adaptable to different thicknesses of the operating element, and said coverings being mounted to support the copy on each side of the impact line.

2. The guiding device for extensible operating elements according to claim 1, wherein said coverings are formed with rounded features on a side thereof facing towards said opening through which the operating element is extensible.

3. The guiding device for extensible operating elements according to claim 1, wherein said coverings are displaceably received on the cylinder surface.

4. The guiding device for extensible operating elements according to claim 1, wherein said coverings are formed of abrasion-resistant plastic material.

5. The guiding device for extensible operating elements according to claim 1, wherein said coverings are formed of metal.

6. The guiding device for extensible operating elements according to claim 1, wherein said coverings have an opening formed therein.

7. The guiding device for extensible operating elements according to claim 6, wherein said opening is formed as a slot.

* * * * *